United States Patent [19]

Greive

[11] 4,114,357

[45] Sep. 19, 1978

[54] THREAD-WETTING ARRANGEMENT FOR YARN-TWISTING APPARATUS

[75] Inventor: Aloys Greive, Münster, Germany

[73] Assignee: Hamel GmbH Zwirnmaschinen, Münster, Germany

[21] Appl. No.: 807,649

[22] Filed: Jun. 17, 1977

[30] Foreign Application Priority Data

Jun. 18, 1976 [DE] Fed. Rep. of Germany ..... 2627268

[51] Int. Cl.[2] ..... D01H 13/30; D01H 7/86

[52] U.S. Cl. ..... 57/35; 57/164

[58] Field of Search ..... 57/34 R, 35, 58.49, 57/58.84, 164, 108

[56] References Cited

U.S. PATENT DOCUMENTS

| | | | |
|---|---|---|---|
| 3,938,685 | 10/1976 | Scherf et al. | 57/35 |
| 3,939,635 | 2/1976 | Rehn et al. | 57/35 |
| 4,023,337 | 5/1977 | Speranzin | 57/35 |
| 4,040,241 | 8/1977 | Speranzin | 57/35 |

*Primary Examiner*—Donald Watkins

*Attorney, Agent, or Firm*—Karl F. Ross

[57] ABSTRACT

A thread drawn upwardly from a stationary yarn package into the top of a hollow spindle, exiting from a payoff disk on that spindle below the yarn package and then rising along the inner wall of a balloon-limiting cylinder, is wetted by water entering the top of the cylinder through several peripherally spaced radial wall apertures or through an overhanging spout. An annular trough at the bottom of the cylinder intercepts excess water and returns it to a reservoir for recirculation to a supply channel.

11 Claims, 12 Drawing Figures

39
34
38
37
35
31
2
3
15
6
16
5
4
1
30
7
33
32
8
36
9

THREAD-WETTING ARRANGEMENT FOR YARN-TWISTING APPARATUS

FIELD OF INVENTION

My present invention relates to a thread-wetting arrangement for a yarn-twisting apparatus, especially a bank of devices known as double twisters.

BACKGROUND OF THE INVENTION

In commonly owned U.S. Pat. No. 3,983,685 there has been described a yarn-twisting apparatus of this type in which a thread drawn off a stationary yarn package or spool, centered on an upright axis, is pulled into the open top of a hollow spindle forming part of a thread-guiding structure that is centered on that axis and traverses a spool-supporting platter. The thead exits through a generally radial outlet in a payoff disk, secured to the spindle beneath the platter, and then rises along the inner wall surface of a stationary balloon-limiting cylinder surrounding the yarn package with clearance. An applicator tube, projecting toward a peripheral groove of the payoff disk, contains a wick dipping into a reservoir of treatment liquid, such as water, with which it wets the thread passing periodically across the tip of the tube.

OBJECTS OF THE INVENTION

An object of my present invention is to provide improved thread-wetting means in such an apparatus, allowing the dispensation of larger quantities of water or other treatment liquid to a thread continuously revolving about an axis.

A related object is to provide means in such an apparatus for intercepting, and possibly returning to its source, any excess liquid not absorbed by the revolving thread.

SUMMARY OF THE INVENTION

I realize this object, pursuant to my present invention, by the provision of conduit means communicating with a supply of treatment liquid and opening into the inner wall surface of the balloon-limiting cylinder at an elevated zone periodically swept by the revolving thread, the bottom of the cylinder being equipped with a receptacle for excess liquid.

Advantageously, the wetting zone is formed at or near the upper rim of the cylinder wall where the thread, drawn upwardly through a stationary eye on the cylinder axis, is under a tension counteracting the centrifugal force and is therefore pressed less strongly against the cylinder wall than in the lower region. The liquid may enter this annular zone from an external channel, either through several peripherally spaced wall apertures or via a spout overhanging a funnel-shaped enlargement of the cylinder rim. In either case, the treatment liquid may be recirculated to a reservoir therefor through a return line extending from the receptacle or catch basin at the bottom of the cylinder, especially if that liquid contains a treatment agent.

BRIEF DESCRIPTION OF THE DRAWING

The above and other features of my invention will now be described in detail with reference to the accompanying drawing in which.

SPECIFIC DESCRIPTION

Figure 1:
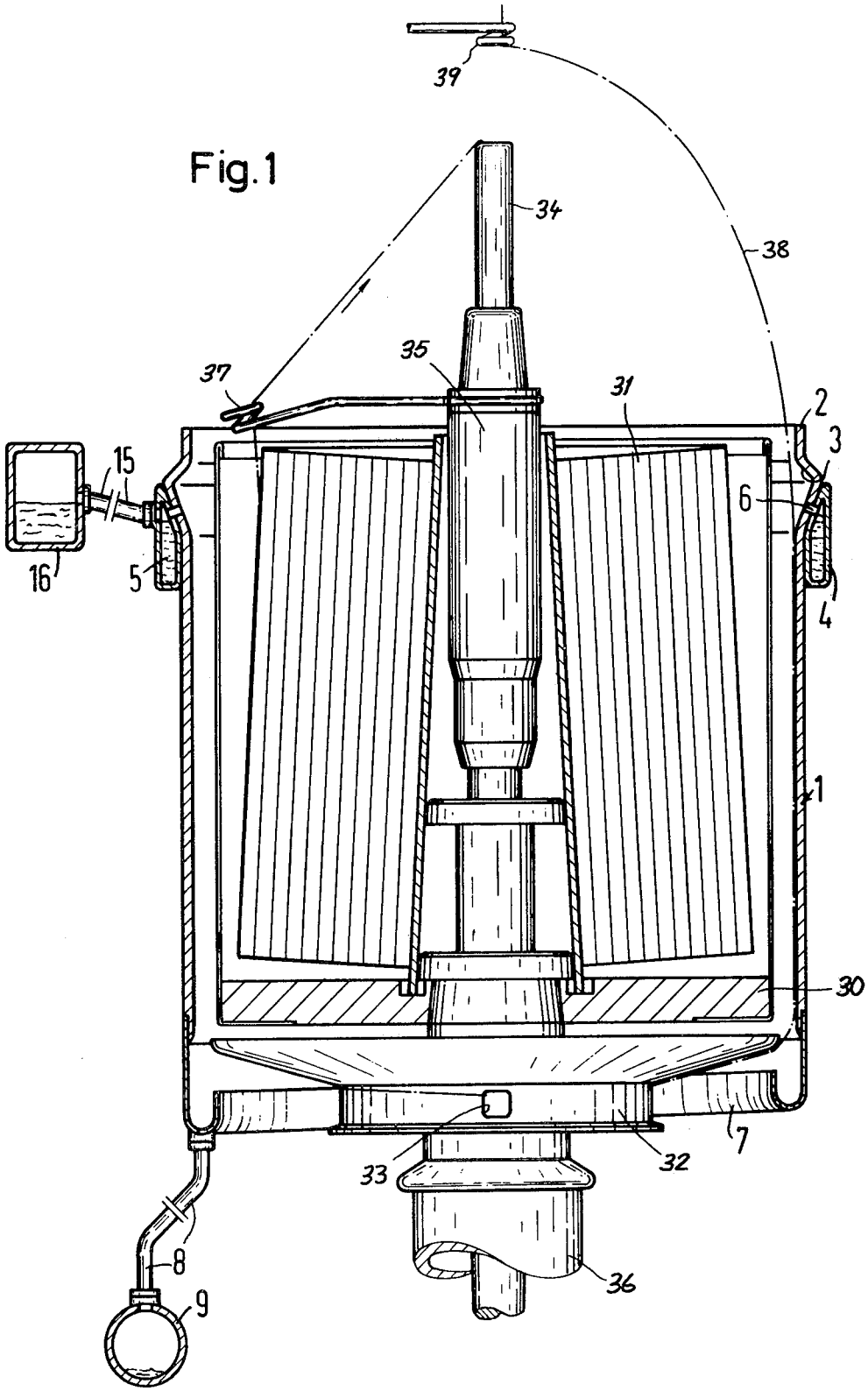
FIG. 1 is a vertical sectional view of a twisting station forming part of an apparatus according to my invention, including a balloon-limiting cylinder communicating with a conduit system for the circulation of a treatment liquid.

In FIG. 1 I have shown a twisting station which is generally similar to that illustrated in prior U.S. Pat. No. 3,983,685 and will therefore be described only in general terms, except for an associated thread-wetting arrangement embodying my invention. The twisting station comprises a platter 30 for the support of a yarn package 31, the platter being held stationary by magnetic means as taught in the above-mentioned patent. A rotary thread-guiding structure, traversing the platter 30, includes a payoff disk 32 with a generally radial outlet 33 mounted underneath the platter 30 on a hollow spindle 34 which also comprises a thread brake 35 and a whorl 36 driven by a nonillustrated motor. An eye 37, eccentrically carried by this structure, is traversed by a thread 38 which is continuously drawn upwardly from yarn package 31 and enters the spindle 34 from above, exiting at the outlet 33 and passing along the underside of payoff disk 32 toward the inner wall surface of a stationary balloon-limiting cylinder 1 which surrounds the platter 30 and the spool 31. The ballooning thread 38, revolving about guide structure 32–37, passes from the upper rim 2 of cylinder 1 through a stationary eye 39 centered on the spindle axis, thereby undergoing a double twist as is well known per se.

Figure 7:
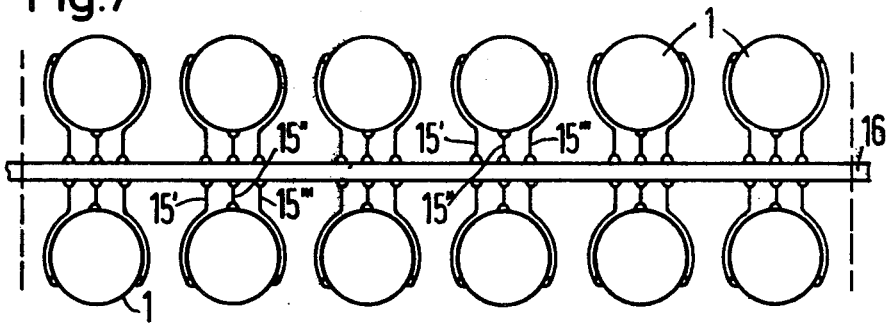
FIGS. 7, 8 and 9 diagrammatically show different arrays of twisting stations supplied by respective branches of a common conduit system.
Figure 8:
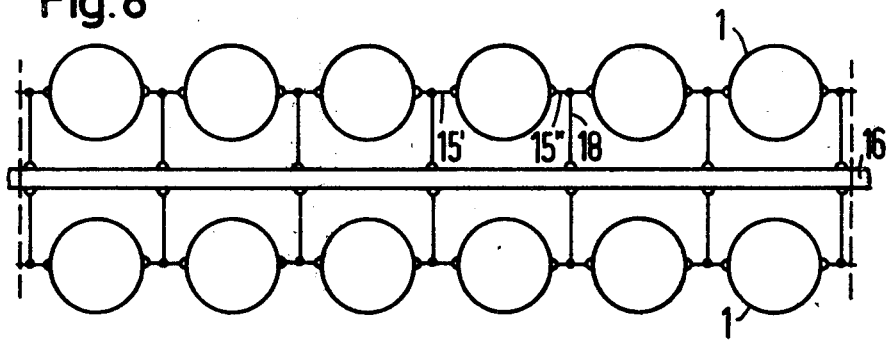
Figure 9:
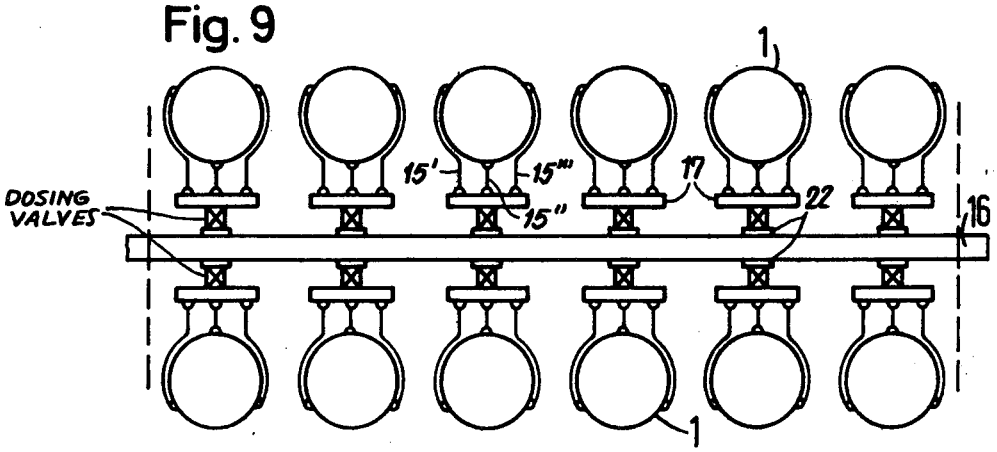

In the embodiment of FIG. 1 cylinder 1 is formed with a horizontal annular groove 3 along its inner wall surface, at an elevated zone just below its upper rim 2. An annular channel 4, surrounding the cylinder, feeds treatment liquid 5 to groove 3 via a plurality of peripherally spaced apertures 6. Channel 4 communicates via a conduit 15 with a supply line 16 which may be common to a multiplicity of twisting stations as illustrated in FIGS. 7–9. Thread 38, revolving across groove 3, is thoroughly wetted and saturated by the liquid, being able to expand fully since it is not in close contact with the cylinder wall for the reasons already explained. Any fiber ends projecting from the thread core are thereby drawn toward the core and are bound to it by the twisting operation taking place above eye 39.

A trough-shaped catch basin 7 is fitted to the lower rim of cylinder 1 and opens into a drain 8 which leads to a collector 9. As described hereinafter with reference to FIG. 6, this collector may return the overflow to a reservoir for recirculation to line 16.

Figure 2:
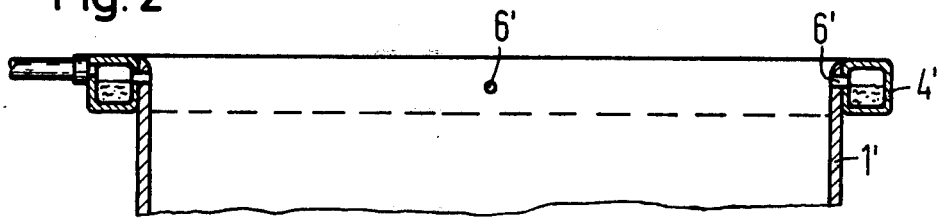
FIG. 2 is a cross-sectional view of the top portion of a modified balloon-limiting cylinder.
Figure 3:
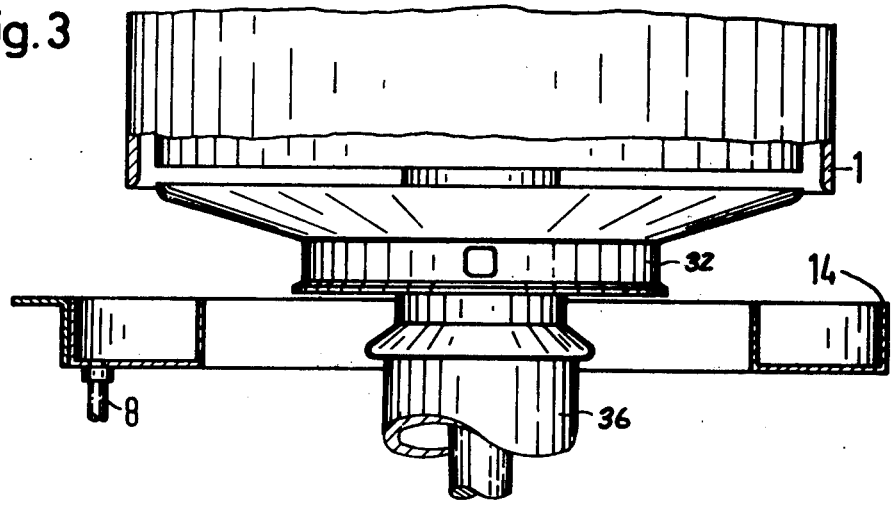
FIGS. 3 and 4 are axial sectional views of the cylinder bottom and an associated catch basin, representing two modifications of the structure of FIG. 1.
Figure 4:
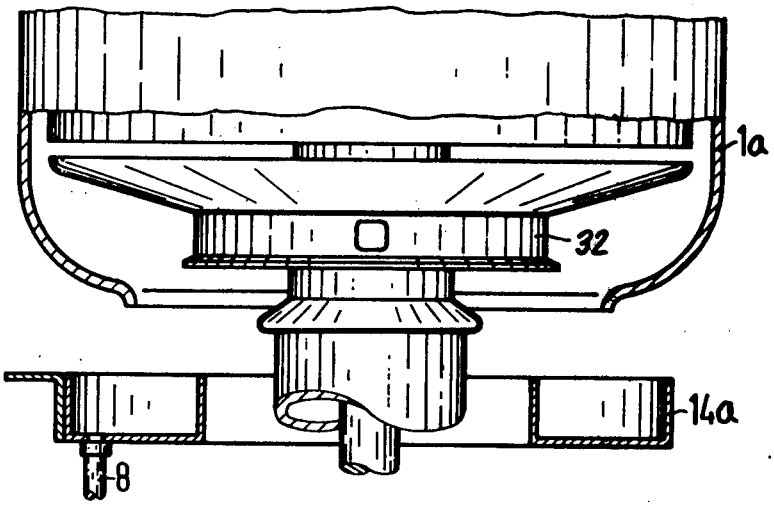

In FIG. 2 I have shown a modified cylinder 1' without the annular groove 3 of FIG. 1; an annular channel 4' closely surrounds its upper rim and communicates with its interior via a plurality of apertures 6'. Channels 4 and 4' could be provided with nonillustrated levelregulating means, e.g. of the float-controlled type. FIG. 3 illustrates a catch basin 14 in the shape of an annular trough, spacedly disposed below cylinder 1, fitted with the drain 8. FIG. 4 shows a modified cylinder 1*a* whose lower end forms a converging skirt above a smaller-diameter receptacle 14*a*.

Figure 5:
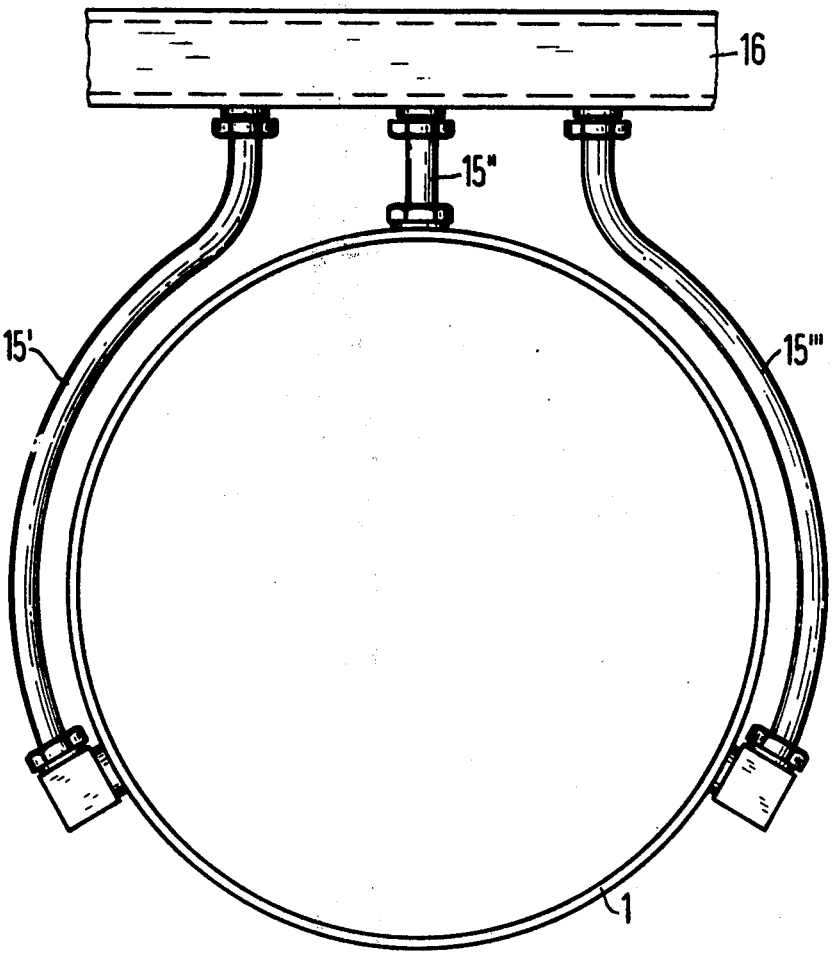
FIG. 5 is a top view of the cylinder with a modified conduit system shown only in part.

As illustrated in FIG. 5, a supply conduit 16 may communicate with an elevated wetting zone inside balloon-limiting cylinder 1 (with or without the annular groove 3 of FIG. 1) through several branch conduits 15′, 15″, 15‴ terminating at peripherally spaced apertures of the cylinder wall. These branch conduits have also been illustrated in FIG. 6 in which a pump 21, driven by a stepping motor 20, feeds the main conduit 16 through an adjustable throttle or dosing valve 22 and a check valve 23 in series therewith. Excess liquid from trough 14 is passed through a filter 24 in a return line 28, serving for the removal of lint and other solids, into a reservoir 26 for recirculation by the pump 21 through an inlet filter 25. Motor 20 is driven by a power supply 27 under the control of a timer 19 which generates a train of stepping pulses of adjustable recurrence frequency.

FIG. 7 shows two banks of cylinders 1, forming part of respective twisting stations, supplied via branch conduits 15′, 15″, 15‴ from a common line 16. In FIG. 8, conduits 15′ and 15″ are connected to branch lines 18 each common to a pair of adjoining cylinders. FIG. 9 shows headers 17 receiving the treatment liquid from the common supply line 16 through respective dosing valves 22 and distributing it to the associated branch conduits. If desired, a separate supply line may be provided for each row of twisting stations to allow their independent operation in the event of a malfunction of one or the other conduit system.

Figure 10:
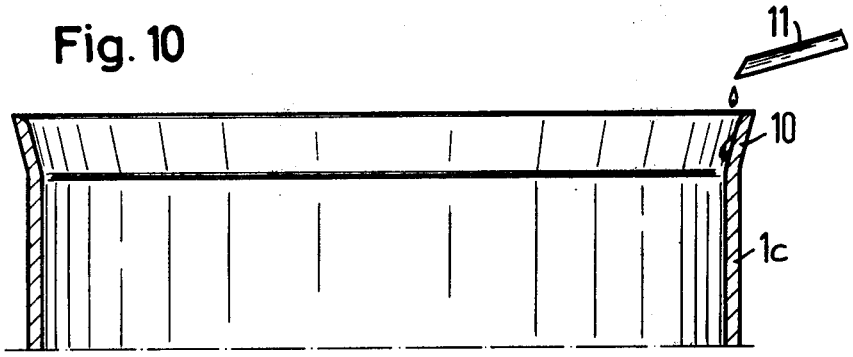
FIGS. 10, 11 and 12 are views similar to FIG. 2, showing variously formed cylinder rims together with an overhanging spout.
Figure 11:
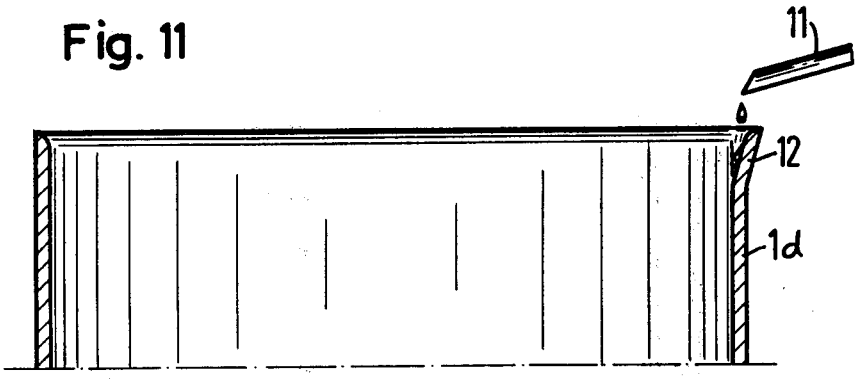
Figure 12:
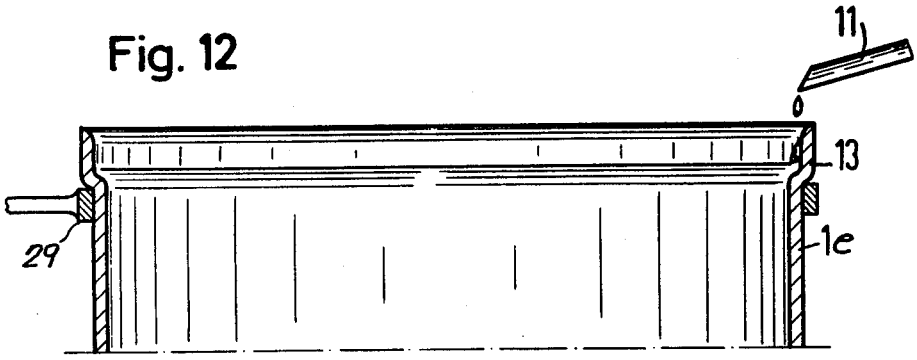

As shown in FIGS. 10–12, the liquid may be supplied to the balloon-limiting cylinder through an overhanging spout 11. According to FIG. 10, a cylinder 1*c* has an upwardly diverging rim 10 which forms a funnel designed to receive the liquid issuing from spout 11. As seen in FIG. 11, only a portion 12 of the upper rim of a cylinder 1*d* need be flared outwardly to form such a funnel. FIG. 12, finally, illustrates the possibility of cylindrically recessing the upper rim of a cylinder 1*e*, the outwardly enlarged rim 13 forming a shoulder for a clamping ring 29 by which the cylinder may be mounted on a supporting frame.

Figure 6:
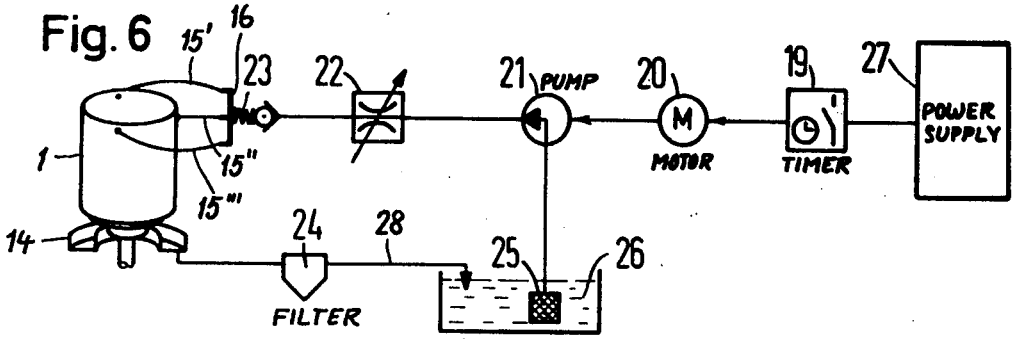
FIG. 6 is a diagrammatic view of the entire conduit system.

The annular catch basin 7, 14 or 14*a* may be split into two or more segments, e.g. as seen in FIG. 6 where only one half of receptacle 14 has been illustrated, which can be laterally swung away from the axis of rotation to facilitate cleaning of the trough.

I claim:

1. A yarn-twisting apparatus comprising:

a stationary support for a yarn package centered on an upright axis;

a thread-guiding structure rotatable about said axis including a hollow spindle traversing said support and terminating in an open top for receiving a thread drawn upwardly from said yarn package, said structure further including a payoff disk on said spindle below said support having a generally radial outlet for said thread;

a balloon-limiting cylinder surrounding said structure and said support, said cylinder having an inner wall surface positioned to surround said yarn package with clearance for the upward guidance of the thread exiting from said outlet and revolving with said structure;

conduit means communicating with a supply of treatment liquid and opening onto said inner wall surface at an elevated zone close to the top of said cylinder periodically swept by the revolving thread for saturating same with said liquid; and a receptacle for excess liquid extending inwardly of said inner wall surface over the entire periphery of said cylinder at the bottom thereof.

2. An apparatus as defined in claim 1 wherein said inner wall surface is formed along said elevated zone with an annular groove centered on said axis, said groove being open toward the interior of said cylinder and being provided with an apertured bottom communicating with said conduit means.

3. An apparatus as defined in claim 1 wherein said conduit means terminates at a plurality of openings traversing the wall of said cylinder at peripherally equispaced locations.

4. An apparatus as defined in claim 3 wherein said conduit means includes an annular channel surrounding the top of said cylinder with said openings.

5. An apparatus as defined in claim 1 wherein said cylinder has an upper rim with at least a portion flared outwardly to form an upwardly open funnel, said conduit means including a spout overlying said funnel.

6. An apparatus as defined in claim 1 wherein said supply comprises a reservoir and pump means for delivering the contents of said reservoir to said elevated zone.

7. An apparatus as defined in claim 6, further comprising a check valve in said conduit means downstream of said pump means.

8. An apparatus as defined in claim 6, further comprising a return line connecting said receptacle with said reservoir.

9. An apparatus as defined in claim 8, further comprising filter means in said return line.

10. An apparatus as defined in claim 1 wherein said support, said structure and said cylinder are duplicated at a plurality of twisting stations, said conduit means including a line common to all said twisting stations.

11. A yarn-twisting apparatus comprising:

a stationary support for a yarn package centered on an upright axis;

a thread-guiding structure rotatable about said axis including a hollow spindle traversing said support and terminating in an open top for receiving a thread drawn upwardly from said yarn package, said structure further including a payoff disk on said spindle below said support having a generally radial outlet for said thread;

a balloon-limiting cylinder surrounding said structure and said support, said cylinder having an inner wall surface positioned to surround said yarn package with clearance for the upward guidance of the thread exiting from said outlet and revolving with said structure, said cylinder further having an upper rim with at least a portion flared outwardly to form a funnel;

conduit means communicating with a supply of treatment liquid and terminating in a spout overlying said funnel to direct said liquid onto said inner wall surface at an elevated zone periodically swept by the revolving thread for wetting same; and a receptacle for excess liquid at the bottom of said cylinder.

* * * * *